United States Patent [19]

Kirkham

[11] 4,102,352

[45] Jul. 25, 1978

[54] INSULATED TENT

[76] Inventor: Arthur J. Kirkham, 5534 Avalon Dr., Murray, Utah 84107

[21] Appl. No.: 737,701

[22] Filed: Nov. 1, 1976

Related U.S. Application Data

[63] Continuation of Ser. No. 670,233, Mar. 25, 1976, abandoned.

[51] Int. Cl.[2] ..... A45F 1/16

[52] U.S. Cl. ..... 135/1 R; 135/3 R

[58] Field of Search ..... 135/1 R, 3 R, 4 R

[56] References Cited

U.S. PATENT DOCUMENTS

| | | | |
|---|---|---|---|
| 3,128,781 | 4/1964 | Kirkham | 135/1 R |
| 3,598,133 | 8/1971 | Abert et al. | 135/1 R |
| 3,621,857 | 11/1971 | May et al. | 135/1 R |
| 3,670,747 | 6/1972 | Pohl et al. | 135/1 R |
| 3,699,986 | 10/1972 | Kirkham | 135/1 R |
| 3,970,096 | 7/1976 | Nicolai | 135/4 R |

*Primary Examiner*—Werner H. Schroeder
*Assistant Examiner*—Conrad L. Berman
*Attorney, Agent, or Firm*—Criddle, Thorpe & Western

[57] ABSTRACT

An insulated tent comprising an externally supported inner tent and an outer fabric wherein the outer fabric comprises interchangeable end sections, door sections and a roof section. The outer fabric is supported by the tent support structure at the top and by conventional means at the bottom. Various combinations may be utilized attaching the outer door sections including flys, canopies and the like to the edges of the outer roof and end sections. Modular systems containing an insulated pavilion and insulated room modules are also included.

33 Claims, 17 Drawing Figures

INSULATED TENT

This is a continuation of application Ser. No. 670,233, filed Mar. 25, 1976, now abandoned.

BACKGROUND OF THE INVENTION AND DESCRIPTION OF PRIOR ART

This invention relates to insulated tents. More particularly, this invention relates to sectionalized double wall tents providing an insulated air space between the inner and outer fabric walls.

Tents have long been a popular and favored form of shelter. As the art has grown, tents have become increasingly more popular due to improvements in fabrics and ease of assembly. With the upsurge of backpacking, there has been a demand for increasingly lightweight, but durable tents, which provide both heat retention and adequate ventilation. Camping in general, and backpacking in particular, are becoming more widespread or common during winter months as well as during milder weather conditions. Camping in cold weather puts a greater demand on both the tent manufacturer and the camper to circumvent the adverse weather conditions, and provide as wide a latitude of comfort within the tent as possible.

Probably the greatest change in tents in recent years relates to support structures which provide more usable space within the tents and to modular tents wherein modules can be added to a central pavilion in any desired combination. Examples of tents, modular systems, and support structures are shown in my U.S. Pat. Nos. 3,128,781; 3,367,348 and 3,699,986.

While such tents can be constructed from lightweight materials such as nylon and utilize lightweight supporting structures such as aluminum, there is often a need to provide an insulating characteristic to such tents without materially adding to the weight.

OBJECT AND SUMMARY OF THE INVENTION

It is a principal object of this invention to provide an economical insulated double wall tent wherein both inner and outer fabric walls are supported by the same upper support structure.

It is also an object of the present invention to provide an insulated double wall tent wherein the insulation comprises an air space between the inner and outer fabric walls but wherein adequate ventilation is provided.

A still further object of the present invention is to provide a double wall tent wherein the outer fabric is attachable to the support frame in sections which may be used separately or in combination.

Additionally, an object of the present invention is to provide an insulated double wall tent also having an outer roof wherein a door or closure section may be attached to the outer fabric and utilized in various combinations or modifications.

Another object of this invention is to provide a tent which is economical and which may be used in all weather conditions. The inner tent with its supporting structure may be used alone in warmer weather or such tent may contain one or two end sections which are interchangeable.

In addition, it is an object of this invention to provide a double wall covering for a tent module and its accompanying pavilion.

Principal features of the invention include a basic sectionalized outer fabric covering for a tent structure having an exterior frame and an inner tent fabric comprising a generally rectangular roof, with downwardly and, if desired, outwardly depending endwalls and sidewalls, said sidewalls containing openings such as windows and/or doors. The sidewalls and endwalls are preferably interconnected at the base by a floor. Sewn or otherwise attached into the roof at either end, adjacent the endwalls, is a sleeve open at both ends adapted to receive a resilient wall support member, said sleeve also preferably has an opening midway along the transverse sleeve length to accommodate a center ridgepole. If desired, a rigid support may be used in the place of a resilient wall support or tensioning member and throughout this invention may be considered an equivalent thereto. However, resilient members are preferable due to their ability to better support both vertical and horizontal pressures or a combination thereof.

The tent floor or base of the walls, if there is no floor, is stretched taut and staked or otherwise secured at the bottom in a conventional manner and is erected and supported by a support frame including three structural members which hold the tent in a taut stressed position both vertically and horizontally. The structural members comprise ground engaging elongated upright means held in a stationary position midway at each end of the tent. An elongated ridge member interconnects said upright means and an elongated resilient wall tensioning member is inserted as a crossarm through each transverse sleeve so that an end protrudes from each end of the sleeve thereby completing the support structure. Each resilient crossarm is restrained at the midway portion defined by the sleeve opening by the upright means, ridgepole or means interconnecting the same at or near the interconnection of the upright means and the ridgepole. The length of the upright and ridgepoles are such that the elongated resilient crossarms cause the sleeves, and the inner tent walls to be urged upwardly and outwardly in a taut positon with the resilient crossarms being bowed arcuately or in a generally downwardly and inwardly curvilinear position.

With the tent in this structurally erected position, the principal features of this invention can be added. Primarily, these features include end sections which may also serve as partial sidewalls adapted to be attached to the tent structure at the top by reinforced apertures such as grommets, located in the upper outer corners which pass over the ends of the resilient crossarms and containing fastening means to secure the central top portion to the support means at or near the juncture of the ridge member and upright means. The top of the outer end section thus may overlap the resilient crossarms along the transverse length thereof. The end section is so shaped to depend downwardly parallel to or flare outwardly at an angle greater than the walls of the inner fabric and is secured at the bottom by conventional means such as staking snow flaps and the like thereby creating an air space between the endwalls and sidewalls of the inner and outer fabrics exclusive of the door openings. As previously noted, the outer end section may be shaped such as to also partially cover the inner sidewalls. Reference, therefore, to the outer end section may also include a partial covering or insulation of the inner tent sidewalls.

An outer roof section is so fabricated as to be of substantially the same shape and size as the inner roof and has reinforced pockets or grommets at each corner thereof. There is a sleeve at either end into which is sewn or otherwise secured a draw cord or elasticized means causing the sleeve to gather. The sleeve of the inner-fabric is so adapted that when the tent is erected the resilient crossarms and ridge member are above the inner roof of the tent. The outer roof is assembled by placing or inserting the end of each crossarm into a reinforced pocket or grommet, or similar fastening means, and the outer roof is stretched taut by overlapping the midportion of the elasticized end over the end of the ridgepole, or by the use of a drawstring. Thus, the outer end section and outer roof overlap at the resilient crossarm to which both are attached. The connection is substantially water resistant but is not necessarily airtight and since the inner roof may be so fabricated to contain air vents, proper ventilation is maintained.

A double walled assembly is thus provided around the tent with the exception of the doorways where several modifications or options may be made as will be described in detail hereafter. For example, a conventional doorway may be detachably connected to or made an integral part of the outer roof and intermesh by means of zippers, ties, self-adhesive material or the like with the adjacent side edges of the end sections to form a complete double walled and roofed structure. Alternately, a canopy can be attached to the outer roof to provide covered storage space for equipment outside the tent and, in colder climates, a tunnel doorway may be utilized.

The outer door closures and outer end sections may be interchangeable in that one end section may be attached to either end of the tent and used without the other sections, if desired. Likewise, with outer end sections at either end of the tent, door closures may be used interchangeably. For example, a conventional closure may be used on one side of the tent to form a double wall and a canopy used on the other side. Or, if desired, a conventional closure and canopy can be attached to the same side.

With an insulated tent erected as has been described, a wide variety of materials may be utilized providing an even greater degree of flexibility. For example, the inner fabric may be made of a breathable material thereby preventing condensation on the inside walls of the inner tent; or if desired, vents in the inner tent structure may be opened to prevent the collection of condensation.

The quality of the inner fabric may also be altered if a double wall structure is to be used. For example, a less expensive material may be utilized and replaced as needed. The same option is, of course, available for the outer sections since each section may be replaced separately.

The fabrics used for inner and outer structures plus the fabric weight, degree of waterproofing and durability are all factors which may be taken into consideration when manufacturing and marketing the tent. The lack of condensation on the inside walls of the inner tent surface is a distinct advantage over prior art structures.

It is this high degree of flexibility and interchangeability that makes the present invention not only novel and economical, but most attractive to campers, whether novices or experienced.

A similar structure is utilized with the room module as disclosed in my U.S. Pat. No. 3,699,986 in that the support structure of the pavilion is essentially the same as has been described except the walls are inverted triangles. In the room module one end is similar to the end previously described. However, the roof is triangular in shape terminating at an apex containing a grommet through which a pin or peg attached to an upright pole may be inserted. A ridgepole interconnects the resilient crossarms at one end and the upright pole at the apex end. The pin or peg is preferably inserted through a hole in the end portion of the ridgepole. The walls depend outwardly and downwardly from the triangular roof structure being an integral part thereof terminating at the apex end in an A frame structure.

In the room module, the outer endwall may be fitted over the end bearing the resilient crossarms in the manner previously described. The outer roof structure consists of a triangular shaped material, the apex end consisting of a grommet or aperture adapted to fit over the pin or peg of the upright pole protruding above the ridgepole. The upper roof then extends over the ridgepole and is fastened at the outer ends by pockets into which the ends of the protruding resilient poles are inserted. The outer sidewalls depend outwardly and downwardly from the outer roof being an integral part thereof, or detachably connected thereto by means of snaps, zippers, self-adhesives and the like. The lower edges of the outer walls may be attached by conventional means such as stakes, snow flaps and the like. The outer sidewalls are preferably connected to the endwalls by detachable means such as has already been defined. A double closure may be formed at the A frame end if desired by means of detachably connecting a double flap closure to the edges of the outer sidewalls, which double flap closure conforms to the shape of the A frame. In other words, each portion of the closure would be substantially in the shape of a right triangle with the hypotenuse being attached to the outer tent wall and the juncture of the flaps having interconnecting means.

The pavilion is similar to the rectangular tent first described insofar as the support structure is concerned. The sides consist of inverted triangular walls with the apex being staked or otherwise fastened to the ground and the base attached to the roof. Various closures adapted to be attached as modules to the pavilion are described in U.S. Patent 3,699,986. An insulated outer lining may be attached to the support structure of the pavilion in the manner similarly described for other outer walls with the exception that the outer walls will also be in the form of inverted triangles. The base may be sewn to or detachably connected to the outer roof. When a room module and pavilion are both insulated the outer walls of the room module and pavilion will join along a line which is outwardly spaced from the normal point of juncture. Self-adhesive fastening means are located in each outer wall at said line.

Additional objects and features of the invention will become apparent from the following detailed description and drawings, disclosing what is presently contemplated as being the best modes of the invention.

DRAWINGS OF THE INVENTION

DETAILED DESCRIPTION OF THE DRAWINGS

Figure 1:
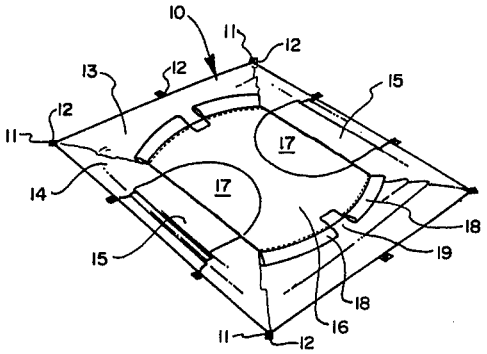
FIG. 1 is an unassembled perspective view of the inner fabric portion of the tent being staked but without additional support structure.

FIGS. 1 - 6 illustrate a conventional single wall tent as now commercially available but which provides the inner fabric and support means for the insulated tent presently claimed.

The tent 10 illustrated in FIGS. 1 - 6 may consist of a floor (not shown) attached to sidewalls which, when stretched taut, may be secured by driving stakes 11 through loops 12. The tent further contains two endwalls 13 and two sidewalls 14 either of which may contain window or door openings 15. Completing the inner fabric structure is a roof 16 which may contain ventilation ports 17 which are covered with a mesh material, but which may be closed by the inner fabric material by appropriate means such as zipped in closures. Sewn into the inner fabric between the endwalls 13 and the roof 16 are sleeves 18 which project outwardly and are adapted to secure part of the structural support means. The sleeves 18 preferably contain an open space 19 at the longitudinal center to allow the preferred assembly of the support structure.

The tent is structurally supported by three basic supporting members, (excluding the stakes), i.e., upright poles 20, ridgepole 21 and resilient crossarms 23. There is a pair of upright poles 20, one being at either end of the tent, which poles may or may not be sectionalized or adjustable. There is a ridgepole 21 which may be adjustable or sectionalized interconnecting the upright poles 20. Preferably, the upright poles and ridgepole are interconnected by means of a notched hinge 22 as more particularly shown in FIG. 6. Passing through sleeves 18 are resilient crossarms 23.

Figure 2:
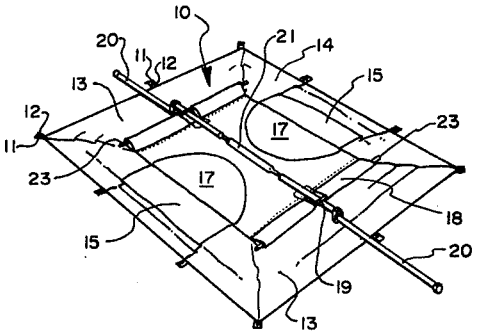
FIG. 2 is an unassembled perspective view of the inner fabric portion of the tent with upright poles and ridgepole being hingedly connected and flexible crossarms inserted into the fabric sleeves.
Figure 3:
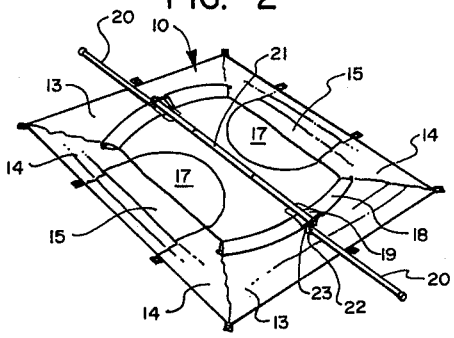
FIG. 3 is an unassembled perspective view of the resilient crossarms illustrated in FIG. 2 being tensioned to engage hinge means interconnecting the upright poles and ridgepole.
Figure 4:
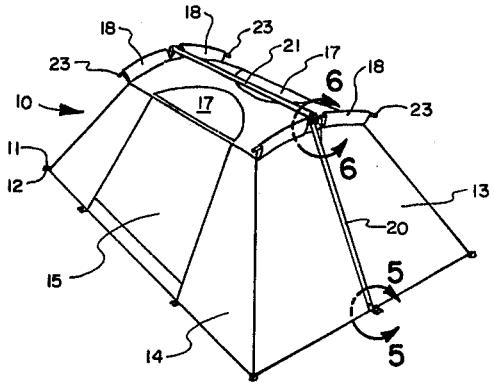
FIG. 4 is a perspective view of the inner tent and a support structure shown in FIG. 3 in a fully erected position.
Figure 5:
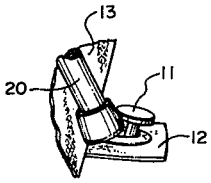
FIG. 5 is an expanded view of the stationary ground engaging portion of the upright poles as taken along lines 5—5 of FIG. 4.
Figure 6:
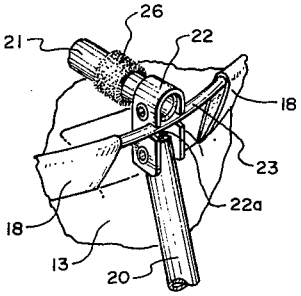
FIG. 6 is an expanded view of one means utilizing a hinge interconnecting the upright poles and ridgepole and illustrating how the resilient crossarm is fixedly restrained thereto as taken along lines 6—6 of FIG. 4.

The tent is assembled by first staking or securing the tent as shown in FIG. 1 and then inserting the structural members 20, 21 and 23 as shown in FIG. 2. The top is placed in a stressed or taut position by inserting the reslient crossarms 23 in the notch 22a or hinge 22 as shown in FIGS. 3 and 6. The endwalls and sidewalls 13 and 14 are then stretched and held taut by raising and securing the upright poles 20. As shown in FIG. 5 the ground engaging end of upright pole 20 is secured between the end of the endwall 13, and tent stake 11 and rested over the loop 12. The upright poles 20 thus keep the tent in a stretched upright position whether or not pressure, vertical or horizontal, or a combination of both, is placed on the upright poles 20. The ridgepole 21 is interconnected to the upright poles 20 by any appropriate means. For example, ridgepole 21 could have transverse holes in the end through which pins connected to the top of upright poles 20 could protrude. Hinge 22, however, demonstrates a preferred embodiment. As previously mentioned, both upright poles and the ridgepole may be sectionalized or be adjustable. Such features have been taught in my aforementioned patents.

The resilient crossarms 23 are tensioned in a bowed or curvilinear position by interconnecting the ridgepole and or upright pole at opening 19 in sleeve 18. As presently illustrated in FIG. 6 this is accomplished by inserting crossarm 23 in the notch 22a of interconnecting hinge 22; however, other equivalent means could be used. The resilient crossarms thus places upward and outward pressure on sleeves 18 thereby pulling the tent walls in a stressed or taut position without the aid of guy ropes, center poles, or additional structural members other than the ridgepole 21 and upright poles 20.

While the features thus disclosed have already been substantially disclosed and claimed in my previous patents, they form the basic foundation comprising the inner wall and support structure for the insulated tent presently being claimed.

Figure 7:
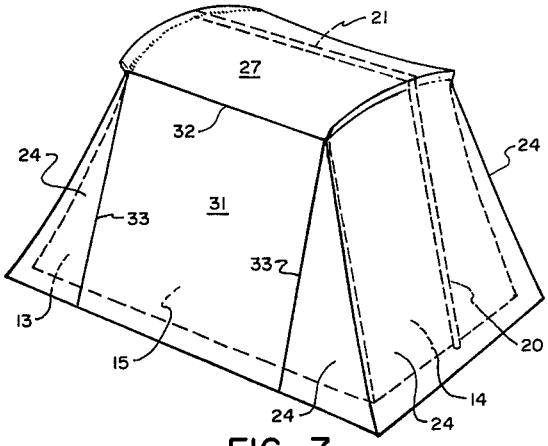
FIG. 7 is a perspective view of a double wall, double roof tent having a conventional door closure and showing the inner fabric and support structure by dotted lines.
Figure 8:
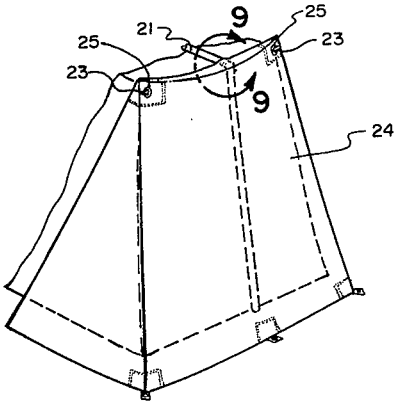
FIG. 8 is a sectionalized perspective view of an end section showing one method of how the top of such piece is attached to the resilient crossbar when in a tensioned position.
Figure 9:
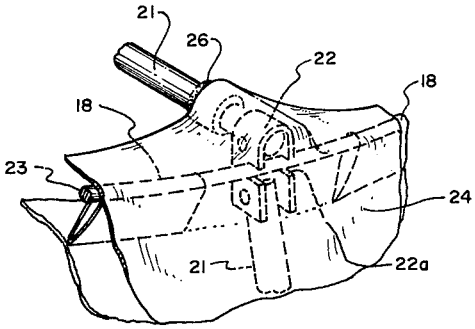
FIG. 9 is an expanded view of one means of attaching the top center of the outer end section to the ridgepole taken along lines 9—9 of FIG. 8.
Figure 10:
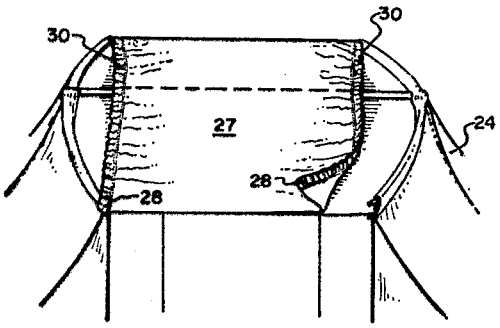
FIG. 10 is a partial perspective view showing the method of attaching the outer roof and securing the ends of the resilient crossarms in pockets.

FIGS. 7-13 illustrate the insulated sectionalized double wall, double roof tent with insulated wall sections which when used in conjunction with the inner tent structure are the subject of the present invention. In addition to various types of door closures, the invention consists of three separate sections of outer fabric, two of which are interchangeable. The outer end sections 24 are interchangeable and may be used separately or in combination. Their colors and/or materials may be different and if and when one outer end section wears out, only that section need be replaced rather than a complete outer covering. The same reasoning also applies to the door closures. The outer covering, therefore, consists of two end sections 24 which, because of their configuration as illustrated in FIG. 8, extend downwardly in a vertical cross plane from the point of attachment to the resilient crossarms 23 thereby serving as both end pieces and partial side coverings, exclusive of door openings.

Each outer end section is reinforced at the corners. The outer edges at the top contain reinforced apertures of grommets 25 which slip over the ends of the resilient crossarms 23. Midway across the top of end section 24 are fastening means 26 which are adapted to loop or wrap around the ridgepole, upright pole or interconnecting means and may consist of two straps or ties which may be tied or snapped around a pole or interconnecting means. Or, in the alternative, self-adhering material may be used as shown in FIG. 6. Whatever mode is used, the top of end section 24 is securely fastened to the structural support members 20, 21 and 23 and then depends downwardly and preferably outwardly at an angle from the inner fabric such that the spacing between the bottom of the outer fabric and the inner fabric is greater than is the spacing between the two respective fabrics at the top. The base of the outer fabric is secured by tent stakes 11 and loops 12 or by other convenient securing means such as rocks, "sand bags", snow flaps, etc. Obviously, as illustrated in FIGS. 7 and 8, the outer end section 24 fits about the resilient crossarms and forms a double wall around the tent except in the areas of the doorways. If desired, only one end section 24 may be used insulating only one end of the tent, i.e., the end facing the wind, or other adverse elements. Both end sections may be used, however, with or without an outer roof or outer doors.

Figure 11:
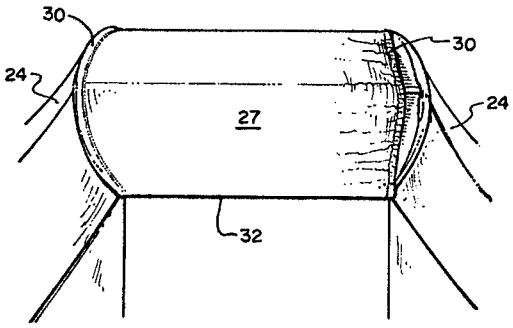
FIG. 11 is a partial perspective view showing the outer roof being stretched taut over the ends of the ridgepoles and resilient crossarms.

The outer roof 27 of the tent is formed in a substantially rectangular shape with reinforced pockets, grommets or other fastening means 28 in each corner. A draw cord or preferably an elasticized cord, not shown, or similar material is connected to the attaching means 28 at either end and is encased in a sleeve 30 wherein the length of the sleeve is sufficient to cover the outer support structure when stretched taut. Once the ends of the resilient crossarms 23 have been inserted into attaching means 28, the ends of roof 27 can then be stretched as illustrated in FIG. 11 to cover and overlap the ends of ridgepole 21 or the interconnecting hinge 22 and the resilient crossarms 23. This forms a waterproof barrier between roof 27 and ends 24 but does not entirely prevent air circulation.

In the position just described, the tent is insulated by double walls and a double roof in all areas except the door openings wherein many modifications may be utilized without departing from the scope of spirit of this invention. Since the principal object of the invention is to create an insulated lightweight tent, suitable for cold weather camping, it is important that the maximum area surrounding the inner tent fabric be insulated. Lightweight fabric such as ripstop nylon or the like will be the preferred fabric, however, any desired material ranging from heavy canvas to lightweight material may be used.

The covering over the door areas may be an integral part of roof 27 but is preferably detachable therefrom. Thus, using FIG. 7 for illustrative purposes, an outer door 31 may be detachably connected along line 32 to roof 27 by means of a zipper, snaps, self-adhesive material or the like. Door 31 may in a similar manner be connected to end section 24 by fastening means 33 such as zippers, ties or snaps, portions of which are contained in endwall 24 and the intermeshing or interengaging portions contained in door 31. If desired, for ventilation, a window (not shown) may be contained in the door 31. In the alternative (not illustrated) the door 31 may be divided in half vertically and each side sewn or permanently attached along line 33 to the outer end section and then attached along line 32 and zipped or otherwise attached along a vertical center line. As can be readily seen, the variations are innumerable.

Figure 12:
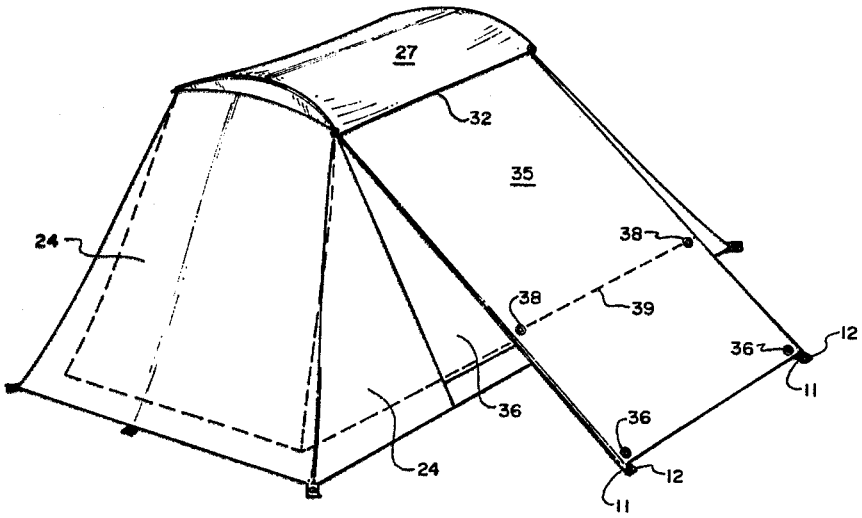
FIG. 12 is a perspective view of a double wall, double roof tent fully assembled containing a closure adaptable for use as either a fly or canopy.
Figure 13:
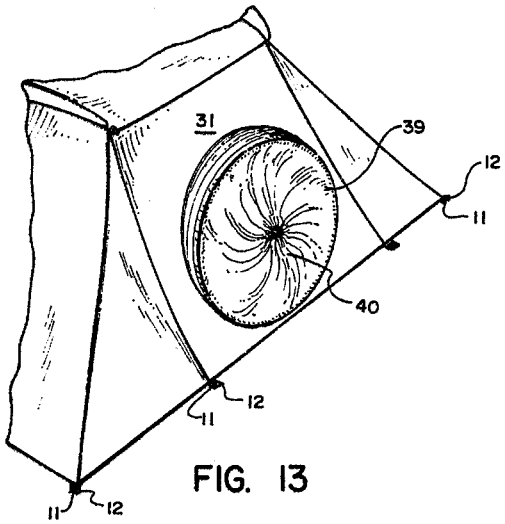
FIG. 13 is a sectionalized view of a closure utilizing a tunnel entry.

Other modifications are shown in FIGS. 12 and 13. In FIG. 12 a closure is shown wherein a canopy or fly 35 may be utilized. If desired, a clear vinyl closure may underlie the canopy to complete the double wall. While the canopy 35 as illustrated in FIG. 12 is angled from line 32 to the ground it may also contain grommets 36 into which poles (not shown) may be inserted to hold the canopy in any position from the ground to a horizontal plane depending upon the poly lengths. Obviously, the poles may be adjustable.

Alternatively, poles may be inserted into grommets or reinforced apertures 38 to form a fold line 39 and the bottom of the canopy may be staked by stakes 11 through loops 12 to the ground thus creating a storage area wherein food, cooking gear and the like may be stored under a shelter. Again, it is obvious that many variations may be utilized. For example, sidewalls may be attached to the canopy.

An additional feature or modification is shown in FIG. 13 wherein a tunnel door 39 is utilized thus minimizing the heat lost from within the inner tent. A substantially cylindrical lining (not shown) may be interposed between the inner tent door and the outer tent door, such lining being substantially at right angles to said doors. If desired, the door opening may terminate in a drawstring closure 40. The drawstring closure 40 of the tunnel 39 will allow only minimal exposure to the outside elements thereby substantially lessening loss of heat from the inside of the tent.

Most tents will be equipped with doors on either sidewall of the inner fabric. When only one door is present or is being utilized, the side not having a door or not being used may be insulated by use of a conventional outer door 31 as above explained.

Figure 14:
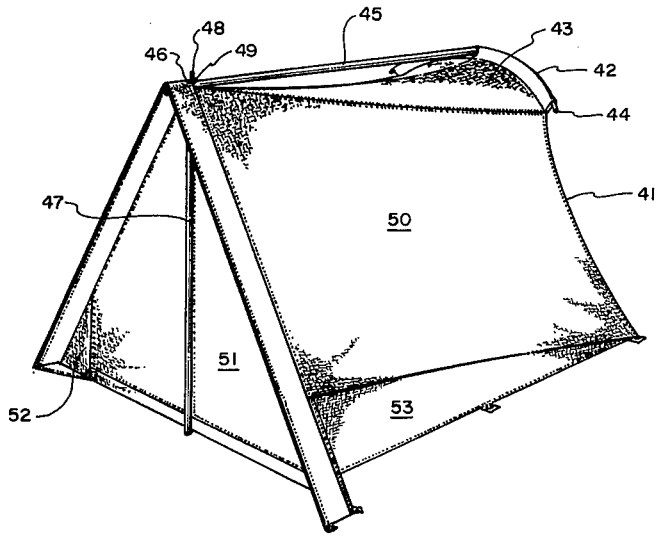
FIG. 14 is a perspective view of a closed bedroom module.

When utilizing a bedroom module as illustrated in FIG. 14, modifications to the insulating walls as previously disclosed may be made. The end 41 shown is similar to end 24 and contains a sleeve 42 sewn between the roof 43 and end 41 adapted to receive a resilient crossarm 44. The resilient crossarm is supported by an upright pole (not shown) which is similar to upright pole 20. However, in the room module the hinge means 22 may be an integral unit having hollow open ends into which the ends of the upright pole, ridgepole 45 and resilient crossarms 44 may fit. Obviously, the resilient crossarms may be divided into two sections with one end fitting into each side of the central integral unit. The ridgepole 45 extends the length of the roof 43, which roof terminates in a fastening means such as a grommet or reinforced aperture 46. An upright pole 47 has a pin or peg 48 appended to the upper end thereof which pin or peg extends through grommet 46 and a transverse aperture 49 in the end of ridgepole 45. Sidewalls 50 depend outwardly and downwardly from the outer edges of roof 43 and are interconnected thereto by sewing or other means. Likewise, the sidewalls are attached to endwall 41 and to closure flaps 51 which, as illustrated, are preferably on the inside of upright pole 47. The inner tent walls 50 as illustrated in FIG. 14 may contain a flap 52 at the A frame end and have a vertical wall section 53 extending from the bottom portion of end 41 to the top of flap 52. The bedroom module per se is already illustrated and forms a part of my U.S. Pat. No. 3,699,986.

Figure 15:
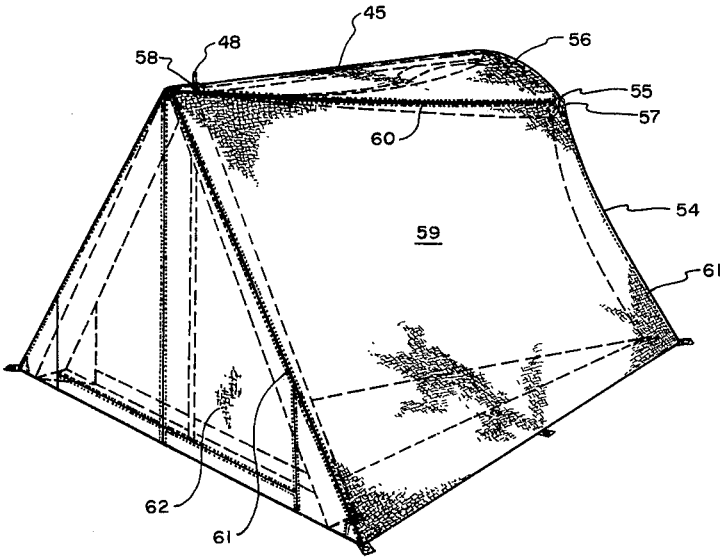
FIG. 15 is a perspective view of a closed room module shown in FIG. 14 being fully insulated by double walls, roof and ends.

This module may be insulated according to the present invention by means substantially already disclosed and illustrated in FIG. 15. The end section 54 may contain grommets 55 (not shown in FIG. 15) which pass over the ends of resilient crossarms 44 and depend downwardly and outwardly to form a double end section being anchored at the base by means already described. The outer roof 56 may contain apertures or pockets 57 adaped to fit over the ends of crossarms 44 and an aperture or grommet 58 adapted to fit over peg 48 above ridgepole 45. The outer sidewalls 59 may be integral with the outer end section 54 and outer roof 56 or may be detachably connected thereto along lines 60 and 61. Attachment means such as zippers, snaps, self-adhesives and the like already mentioned may be utilized. At any rate the outer walls 59 depend downwardly and outwardly from line 60 and interconnect with line 61. The bottom again may be secured by stakes passed through loops or by flaps covered with sand, snow, rocks and the like.

When the bedroom module is attached to a pavilion, as disclosed in my U.S. Pat. No. 3,699,986, there will be no need for further insulation of end flaps 51. However, when used separately, an end section comprising outer flaps 62 may be connected to the forward edge of outer sidewalls 59. The flaps 62 are sectionalized as right triangles with the hypotenuse interconnecting outer sidewall 59 and the longer edges of the right angles meeting outside of and adjacent upright pole 47 to complete the double closure.

Figure 16:
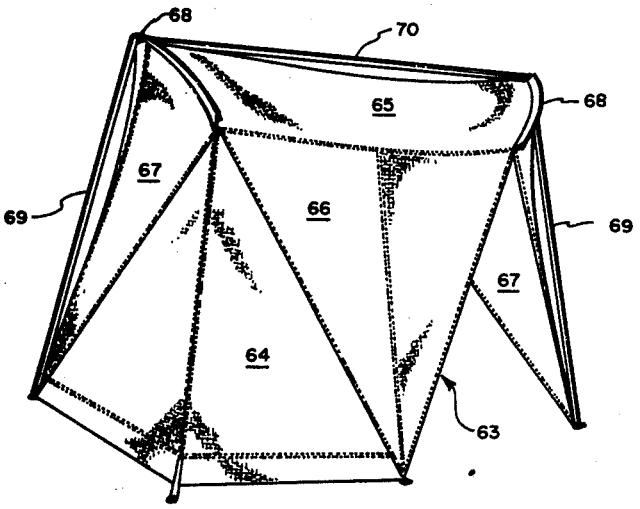
FIG. 16 is a perspective view of a pavilion having one closure attached thereto.

Obviously, other modifications could be made such as also insulating the pavilion, closures, and extension flys as well as the bedroom module just discussed. The inner structures are all illustrated in my U.S. Pat. No. 3,699,986. FIG. 16 illustrated an open pavilion having one closure 64 attached thereto. As noted, the support structure is essentially the same as for the tent previously described which utilizes two flexible crossarms. As illustrated, the pavilion consists of a roof 65 to which are sewn four walls in the shape of inverted triangles. Two opposing sidewalls 66 are attached directly to the roof. The endwalls 67 are interconnected to the roof 65 having a hollow sleeve 68 interposed and sewn between. The sleeves 68 are similar to sleeves 18 and, preferably, also have an opening midway of the longitudinal sleeve length similar to opening 19.

The support structure consists of two upright poles 69, which are preferably adjustable, located at either end interconnected with ridgepole 70, which is also preferably adjustable. The interconnecting means are not clearly shown in FIG. 16 but may consist of a hinge such as hinge 22, or may be a separate piece having apertures into which the ends of ridgepole 70 and upright poles 69 may be inserted. Resilient crossarms 71 are inserted into sleeves 68 and are held in a bowed curvilinear position by the support structure at or about the point of juncture of the upright poles with the ridgepole. If the means interconnecting the upright and ridgepole contain apertures into which said poles are inserted, then the resilient crossarms may be divided into two separate sections, one end of which is inserted into the interconnecting means and the other end protruding from the outer opening of sleeve 68.

With the pavilion in an erected position as shown in FIG. 16, the triangular walls extend downwardly and slightly outwardly with the apex containing conventional means for serving the walls to the ground. The resilient crossarms are in a tensioned curvilinear position holding the sides and endwalls in a taut condition. The upright and ridgepoles are adjusted to be of proper length. FIG. 16 shows a closure 64 also attached to the pavilion, however, an extension fly or bedroom module could also be attached.

Figure 17:
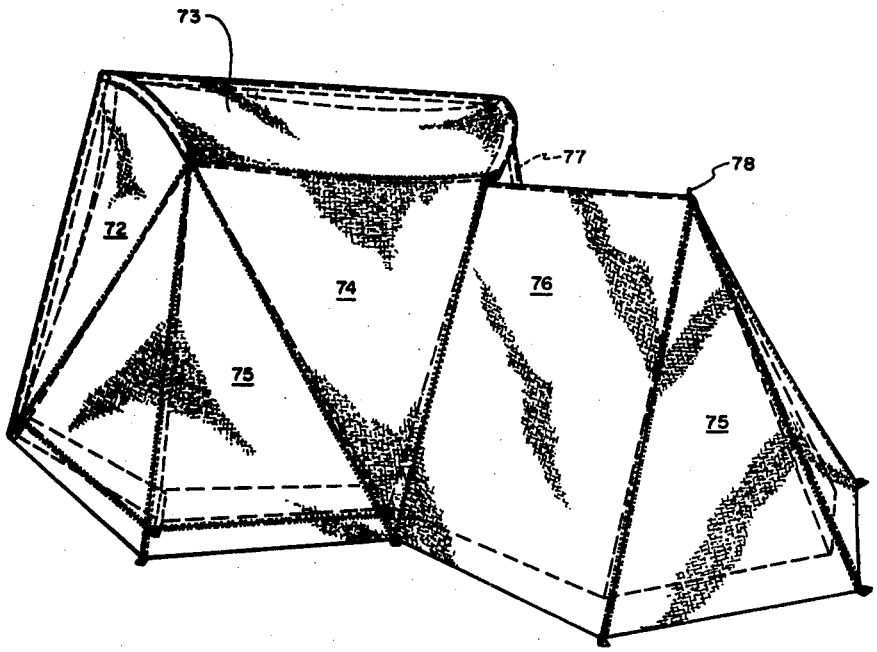
FIG. 17 is a perspective view of a pavilion shown in FIG. 16 being fully insulated and also containing an insulated extension fly and closure.

There is shown in FIG. 17 one embodiment for completely insulating a pavilion, but the invention, insofar as the pavilion is concerned, should not be limited to the illustrated structure.

The outer ends 72 are assembled in the same manner as the end pieces 24 shown in FIGS. 7 – 12 except that the shape is triangular. The outer roof 73 is assembled the same as outer roof 27, again as illustrated in FIGS. 7 – 12. The outer sidewalls 74 are attached to outer roof 73 as has also been previously shown. Thus, the pavilion 63 may be insulated with double walls, ends and a roof in the manner herein illustrated and described.

With the illustrations and disclosure which has thus been made, various other modifications and adaptations will become apparent and form a part of this invention. Thus, the insulated room module of FIG. 15 could be attached to the insulated pavilion. In the alternative, FIG. 17 shows two other insulated adaptations. The closure 64 shown in FIG. 16 could be insulated by an outer wall 75 which would be attached to outer endwalls 72 and sidewalls 74 by prearraned fastening means such as zippers, snaps, self-adhesive material and the like. FIG. 17 further illustrates an insulated extension fly. The extension fly is illustrated and fully disclosed in my U.S. Pat. No. 3,699,986. The outer walls 76 of the extension fly are subject to various modes of assembly. As illustrated, the extension fly is supported by two upright poles inserted through grommets, only the peg ends 77 of which are shown. The outer fly 76 can be sectionalized into one or two sections. Grommets or reinforced apertures can be placed in outer sidewall 76 to fit over the peg ends 77. If desired, only one sidewall 76 need be used at a time and the sidewalls may be interchangeable. Obviously, one sidewall which would overlap both sides of the extension fly could be used with the grommets being located midway of the length of the sidewall for insertion over pegs 77. The extension fly closure outer cover is he same as closure 75. The means of attaching the edges of sidewall 76 to outer pavilion wall 74 and closure 75 could be accomplished by the conventional means already mentioned.

The sectionalized nature of the double wall structure and the ability to use or replace one section at a time provides a great advantage over other double wall tents where the outer wall comprises one integral unit. Such units are cumbersome to erect and in the event one section wears out or is damaged the extensive repairs must be made or the entire outer unit replaced.

Although the invention as has been described is deemed to be that which would perform a preferred embodiment, it is recognized, as has been repeatedly stated, that departures may be made therefrom without departing from the scope of the invention. The invention is not to be limited to the details disclosed, but is to be accorded the full scope of the claims so as to include any and all equivalent insulating closures.

What is claimed is:

1. An insulated tent comprising (a) a flexible inner tent structure having interconnecting end and sidewalls, one or more of said sidewalls containing doors, a roof interconnecting said walls and hollow sleeves adapted to receive resilient crossarms, said sleeves being of substantially the same length as the end of the upper portion of said endwalls, and being fixedly connected to and extending outwardly of the inner tent structure along the interconnecting portion of the endwalls and roof;

(b) support structure external of the inner tent having means to hold the base of the inner tent walls in a taut rectangular substantially horizontal position including, an upright pole extending upwardly, adjacent to and midway of each endwall, said upright pole being at least as long as the distance between the top and bottom of the endwall, a horizontal ridgepole of substantially the same length as the length of the inner roof fabric, said ridgepole interconnecting the upright poles at each end by fastening means, resilient crossarms being inserted into said sleeves, said crossarms being longer than said sleeves thereby protruding from each end sleeve opening, means holding said crossarms in a fixed, tensioned, curvilinear position by means contacting the central portion of said resilient crossarms, the outer portion of the ridgepole or the fastening means interconnecting said poles, said support structure functioning such that the upright poles hold the tent in a taut vertical position, the ridgepole holds the tent in a taut horizontal direction along the ridgepole and the resilient crossarms pull the tent walls and roof outwardly and upwardly in a taut position;

(c) at least one but not more than two outer end sections fitted to the upper portion of either end of the supporting tent structure having a configuration substantially the same as, but larger than, the end portion of the inner tent structure taken along a vertical transverse plane of the inner tent structure approximately at the points the resilient crossarms protrude from the open ends of the sleeves, said outer end sections containing reinforced apertures in the upper corners thereof adapted to fit over the ends of the resilient crossarms and rest against the outside edges of said sleeves in a taut position, fastening means located at the top midportion of said outer end section for fixedly securing said portion to the support structure in the vicinity of the juncture of the upright poles and ridgepole and means for securing the bottom of said outer end section in a taut position spaced outwardly from the inner tent structure thereby creating an insulated air space between the inner tent walls and the outer end sections at either or both ends of the inner tent structure.

2. An insulated tent according to claim 1 wherein each outer end section extends outwardly and downwardly in a taut position such that the space between the outer end section and inner tent walls at their respective bases is greater than the space between the outer end sections and inner walls at the top.

3. An insulated tent according to claim 2 wherein only one end of the inner tent structure is covered by an outer end section.

4. An insulated tent according to claim 2 wherein both ends of the inner tent structure are covered by outer end sections.

5. An insulated tent according to claim 4 wherein the outer end sections are interchangeable.

6. An insulated tent according to claim 5 wherein the tent additionally contains an outer roof.

7. An insulated tent according to claim 6 wherein the outer roof is of substantially the same configuration as the inner roof having reinforced apertures in each corner and fastening means attached to each reinforced aperture contained in a sleeve and extending across the outer roof ends, the length of the fastening means being such that when the ends of the resilient crossarms are inserted into said reinforced apertures the fastening means may be adjusted to overlap the ends of said upright poles, ridgepole and sleeve containing said resilient crossarms, thereby creating an upper insulated double roof.

8. An insulated tent according to claim 7 wherein the outer ends and outer roof have affixed thereto outer door sections on either side thereby completely providing a sectionalized outer cover around the inner tent structure creating an air space between said inner tent structure and said sectionalized outer cover.

9. An insulated tent according to claim 8 wherein the outer doors from an integral part of the outer roof and the adjacent portions of the end sections and outer doors contain means for being vertically interconnected.

10. An insulated tent according to claim 8 wherein the outer doors are detachably connected to the outer roof and adjacent portions of the outer end sections by interconnecting means.

11. An insulated tent according to claim 10 wherein at least one of the adjacent inner doors and outer doors are interconnected by a tunnel door.

12. An insulated tent according to claim 11 wherein the tunnel door has a drawstring closure.

13. An insulated tent according to claim 8 wherein at least one outer door connected to the outer roof is in the form of an outer canopy having a length longer than the length of the adjacent side portions of the end sections.

14. An insulated tent according to claim 13 wherein the outer door connected to the outer roof is a double door consisting of both an outer canopy having a length longer than the length of the adjacent side of the end portions and an underlying outer door section affixed to the outer roof and adjacent portions of the end sections.

15. An insulated tent comprising (a) a flexible inner room module containing an end and interconnecting sidewalls and a triangular roof interconnecting said end and sidewalls and a hollow sleeve adapted to receive resilient crossarms, said sleeve being of substantially the same length as the upper portion of the endwall and being interposed between the base of the triangular roof and the top of said endwall in an outward direction, said roof having fastening means at the apex portion thereof;

(b) support structure external of the inner room module having means to hold the base of the room module in a taut substantially rectangular horizontal position, an upright pole extending upwardly, adjacent to and midway of the endwall, said upright pole being at least as long as the distance between the top and bottom of the endwall, an upright pole having fastening means attached to the upper end thereof, said means interconnecting with the fastening means at the apex end of said roof, a horizontal ridgepole interconnecting the upright poles at each end by fastening means, a resilient crossarm inserted into the sleeve, said crossarm being longer than said sleeve thereby protruding from each end sleeve opening, said crossarm being held in a fixed, tensioned curvilinear position by contact of the crossarm at the central end section with the upright pole, ridgepole or means interconnecting the same, said ridgepole, upright poles and resilient crossarm functioning with the base securing means to hold the tent in an upright taut position;

(c) an outer end section fitted to the tensioned support structure at the end having a configuration substantially the same as but larger than the end portion of the inner tent structure taken along a vertical transverse plane of the inner tent structure approximately at the points the resilient crossarms protrude from the open ends of the sleeve, said outer end section containing reinforced apertures in the upper corners thereof adapted to fit over the ends of the resilient crossarms and rest against the outside edges of said sleeve in a taut position, fastening means located at the top of the midportion of said outer end section for fixedly securing said portion to the support structure in the vicinity of the juncture of the upright poles and ridgepole, and means for securing the bottom of said outer end section in a taut position spaced outwardly from the inner tent structure thereby creating an insulated air space between the inner tent walls and outer end section.

16. An insulated tent according to claim 15 wherein the outer end section extends outwardly and downwardly in a taut position such that the space between the outer end section and inner room module endwall at their respective bases is greater than the space between the outer end section and inner endwall at the top.

17. An insulated tent according to claim 16 wherein the tent additionally contains an outer roof.

18. An insulated tent according to claim 17 wherein the outer roof is of substantially the same configuration as the inner roof having reinforced apertures at each corner, the aperture at the apex end interengaging with the fastening means attached to the upright pole in a position above the ridgepole, the corners at the base end having reinforced apertures and fastening means attached to each reinforced aperture at said base end contained in a sleeve extending across said base end, the length of the fastening means being such that when the ends of the resilient crossarms are inserted into the reinforced apertures the fastening means may be adjusted to overlap the ends of said upright pole, ridgepole and sleeve containing said resilient crossarm thereby creating an insulated upper double roof overlapping on insulated double end section.

19. An insulated tent according to claim 18 wherein the outer end and outer roof have affixed thereto outer sidewalls which depend downwardly and outwardly from said roof section and interconnecting said end section, said outer sidewall being stretched taut and fixedly secured at the base thereby creating an insulated air space between said inner room module sidewalls and endwall and said outer sidewalls and endwall.

20. An insulated tent according to claim 19 wherein the outer roof endwall and sidewalls form an integral unit.

21. An insulated tent according to claim 19 wherein the outer roof, endwalls and sidewalls are detachably connected and form separate sections.

22. An insulated modular tent comprising (a) a flexible inner tent pavilion structure having interconnecting end and sidewalls, said end and sidewalls being in the shape of inverted triangles, a roof interconnecting said walls at their triangular base and hollow sleeves adpated to receive resilient crossarms, said sleeves being of substantially the same length as the upper base portion of said triangular endwalls, and being fixedly connected to and extending outwardly of the inner tent structure along the interconnecting portion of the triangular endwalls and roof;

(b) support structure external of the inner tent having means to secure the apex base of the inner tent walls in a substantially horizontal position, an upright pole extending upwardly, adjacent to the midway of each triangular endwall, said upright pole being at least as long as the distance between the center of the top and bottom of the endwall, a horizontal ridge pole of substantially the same length as the length of the inner roof fabric, said ridgepole interconnecting the upright poles at each end by fastening means, resilient crossarms inserted into said sleeves, said crossarms being longer than said sleeves thereby protruding from each end sleeve opening, means holding said crossarms in a fixed, tensioned, curvilinear position by means contacting the central portion of said resilient crossarms, said support structure functioning such that upright poles hold the tent in a taut vertical position, the ridgepole holds the tent in a taut horizontal direction along the ridgepole and the resilient crossarms pull the triangular tent walls and roof outwardly and upwardly in a taut position;

(c) at least one but not more than two outer end sections fitted to the upper portion of either end of the supporting tent structure having a configuration substantially the same as the inverted triangular end portion of the inner tent structure, said outer end sections containing reinforced apertures in the upper corners thereof adapted to fit over the ends of the resilient crossarms and rest against the outside edges of said sleeves in a taut position, fastening means located at the top midportion of said outer end section for fixedly securing said portion to the support structure in the vicinity of the juncture of the upright and ridgepole and means for securing the bottom apex of said outer end section in a taut position spaced outwardly from the inner tent structure thereby creating an insulated air space between the inner tent walls and the outer end sections at either or both ends of the inner tent structure.

23. An insulated tent according to claim 22 wherein the outer end section extends outwardly and downwardly in a taut position such that the space between the outer end section and inner tent walls at their respective bases is greater than the space between the outer end sections and inner walls at the top.

24. An insulated tent according to claim 23 wherein only one end of the inner structure is covered by an outer end section.

25. An insulated tent according to claim 23 wherein both ends of the inner tent structure are covered by outer end sections.

26. An insulated tent according to claim 25 wherein the outer end sections are interchangeable.

27. An insulated tent according to claim 26 wherein the tent additionally contains an outer roof.

28. An insulated tent according to claim 27 wherein the outer roof is of substantially the same configuration as the inner roof having reinforced apertures in each corner and fastening means attached to each reinforced aperture contained in a sleeve and extending across the outer roof ends, the length of the fastening means being such that when the ends of the resilient crossarms are inserted into said reinforced apertures the fastening means may be adjusted to overlap the ends of said upright poles, ridgepole and sleeve containing said resilient crossarms, thereby creating an upper insulated double roof.

29. An insulated tent according to claim 28 wherein one of the spaces between the outer sidewalls and outer endwalls has affixed thereto an insulated covering thereby providing a sectionalized outer cover around said space.

30. An insulated tent according to claim 28 wherein the spaces between the outer sidewalls and outer endwalls have affixed thereto an insulated covering consisting of an inner fabric having a sectionalized outer cover around said inner fabric thereby creating an air space between said inner fabric and sectionalized outer cover.

31. An insulted tent comprising an inner tent including spaced apart endwalls interconnected by sidewalls extending downwardly from and interconnected by a common ridge line;

means for anchoring lower ends of said sidewalls with respect to the ground;

support frame means holding said inner tent in an erected condition, said support frame means including a ridgepole and at least one wall support member extending transversely to said ridgepole and tensioning the sidewalls upwardly;

outer cover means spaced from said ridge line and said sidewalls by said support frame means; and means for anchoring said outer cover means to the ground at opposite sides of said inner tent, whereby said wall support member tensions the outer cover means upwardly and maintains the sidewalls and outer cover means in a spaced apart relationship.

32. An insulated tent as in claim 31, wherein the central ridgepole is above the common ridge line and supports the outer cover means thereabove.

33. An insulated tent as in claim 32, further including sleeve means connected to the sidewalls and through which each wall support member is inserted, whereby the outer cover means extends over said sleeve means.

* * * * *